US007222811B2

(12) United States Patent
Chang

(10) Patent No.: US 7,222,811 B2
(45) Date of Patent: May 29, 2007

(54) POSITIONING DEVICE OF A DUAL DIRECTION CABLE REEL

(76) Inventor: Wen-Han Chang, P.O. Box 82-144, Taipei (TW)

( * ) Notice: Subject to any disclaimer, the term of this patent is extended or adjusted under 35 U.S.C. 154(b) by 196 days.

(21) Appl. No.: 10/986,358

(22) Filed: Nov. 12, 2004

(65) Prior Publication Data

US 2006/0102765 A1 May 18, 2006

(51) Int. Cl.
*B65H 75/48* (2006.01)

(52) U.S. Cl. ..... 242/378.1; 242/378.2; 242/378.3; 242/385.1

(58) Field of Classification Search ..... 242/378, 242/378.1, 378.2, 378.3, 385.1, 385.3
See application file for complete search history.

(56) References Cited

U.S. PATENT DOCUMENTS 3,596,849 A * 8/1971 Tamarin ..... 242/385.1
4,417,703 A * 11/1983 Weinhold ..... 242/378.3
5,094,396 A * 3/1992 Burke ..... 242/378.2
6,978,960 B2 * 12/2005 Schaller ..... 242/385.3

* cited by examiner

*Primary Examiner*—William A. Rivera
*Assistant Examiner*—Sang Kim
(74) *Attorney, Agent, or Firm*—Leong C. Lei

(57) ABSTRACT

A positioning device of a dual direction cable reel is disclosed. The cable reel comprises a top cover, a pad, a reeling disc top cover, a reeling disc, a lead wire, a spring, a bottom cover and positioning member, characterized in that the reeling disc and the positioning element mounted at the outer side of the bottom cover alternately interact to achieve a positioning function, wherein the positioning element includes a peg and a pulling spring and the peg is pivotally mounted to the peg at the outer edge of the bottom cover, and the rear direction is a pulling spring to provide correct direction, and can swing in accordance with the operational rails at the bottom section of the reeling disc to provide an alternate engaging and disengaging swinging action.

1 Claim, 8 Drawing Sheets

POSITIONING DEVICE OF A DUAL DIRECTION CABLE REEL

BACKGROUND OF THE INVENTION (a) Technical Field of the Invention

The present invention relates to positioning device, and in particular, positioning device of a cable reel for cable retraction.

(b) Description of the Prior Art

Conventionally, the extended cable used in computer is either folded or simply clustered around the PC. This will cause a safety in transmission and the quality of transmission. Thus, in order to obtain highest quality of transmission and highest efficiency of transmission, it is important that the coiled cable or transmission cable should be properly coiled or handled.

FIGS. 10 and 11 show a conventional cable reel A10 including a front cover A1, a spring A2, a sliding seat A3, a transmission cable A4, a positioning bead A5 and a rear cover A6. The spring A2 retracts the transmission cable A4 and a positioning mechanism is a steel bead A5 to position the cable A4. In order to allow the positioning of the steel bead A5, the bottom section of the sliding seat A3 is provided with a plurality of steel bead rail A31 so that the steel bead A5 could be adapted onto the rail A31. However, the design of the rail is difficult and the assembly of the components is troublesome. Further, if the gap of the rail A31 is too large, or damaged, it posses its functionality. As a result, conventional cable reel A10 sometimes disengaged and could not be positioned. Conventional cable reel provides one time cable retraction and it could not have multiple stage cable retraction. Accordingly, it is an object of the present invention to provide a positioning device of a dual direction cable reel, which overcomes the above drawbacks and short comings.

SUMMARY OF THE INVENTION

Accordingly, it is an object of the present invention to provide a positioning device of a dual-direction cable reel having a top cover, a pad, a reeling disc top cover, a reeling disc, a lead wire, a spring, a bottom cover and positioning member, characterized in that the reeling disc and the positioning element mounted at the outer side of the bottom cover alternately interact to achieve a positioning function, wherein the positioning element includes a peg and a pulling spring and the peg is pivotally mounted to the peg at the outer edge of the bottom cover, and the rear direction is a pulling spring to provide correct direction, and can swing in accordance with the operational rails at the bottom section of the reeling disc to provide an alternate engaging and disengaging swinging action, and the functional rails include a pushing section, a second pushing section, a direction-rotating section, an engaging slot and a stopping leading face, wherein the pushing section is a protruded section of the rail, allowing the peg to be pushed at a larger angle so that the peg will fully disengage from engaging mechanism, a second pushing section positioned at the rear direction of the pushing section so that the peg is again pushed to a larger angle to disengage from the engaging mechanism; a direction-rotating section is a recessed section at the rail allowing the peg to be reversed to an engaging corner awaiting reverse rotation to have an engaging mechanism; an engaging slot which is mounted at the rear direction of the pushing section which allows the peg after reverse rotation to be engaged; and the sloping leading face is positioned on the rail to lead the peg into the engaging slot or the pushing section and the peg to implement exact engaging or disengaging mechanism.

A further object of the present invention is to provide a positioning device of a dual direction cable reel, which allow an appropriate length being retracted or extended to be positioned.

Yet a further object of the present invention is to provide a positioning device of a dual direction cable reel, wherein the extension or retraction of cable can be achieved by one action or by multiple-stage.

Still another object of the present invention is to provide a positioning device of a dual direction cable reel, wherein the positioning of cable at an appropriate length is accurate.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
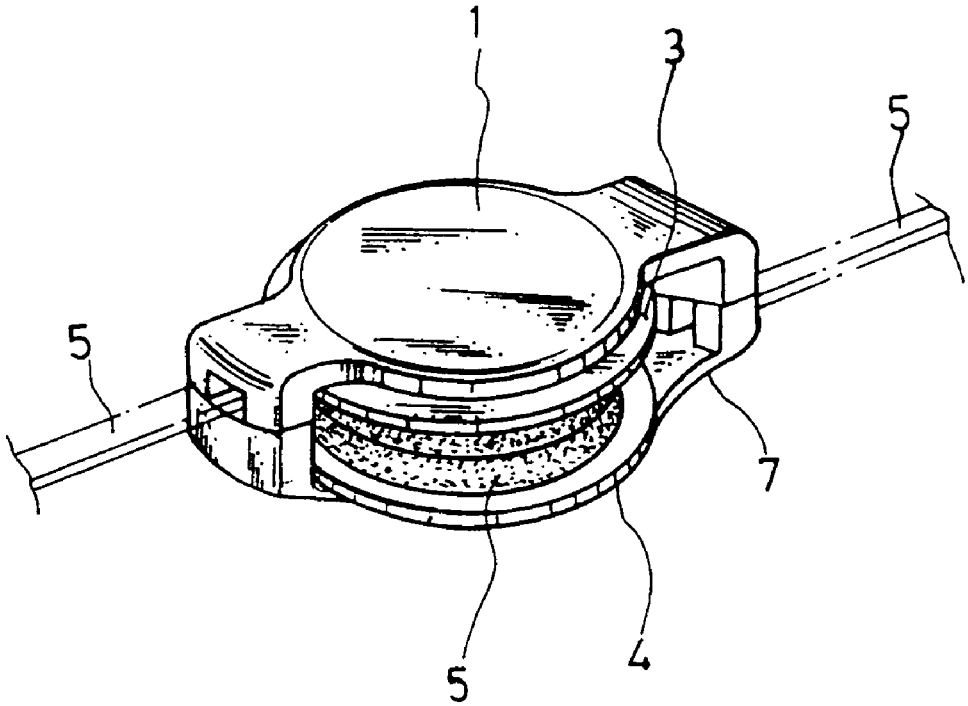
FIG. 1 is a perspective view of a preferred embodiment of the present invention.
Figure 2:
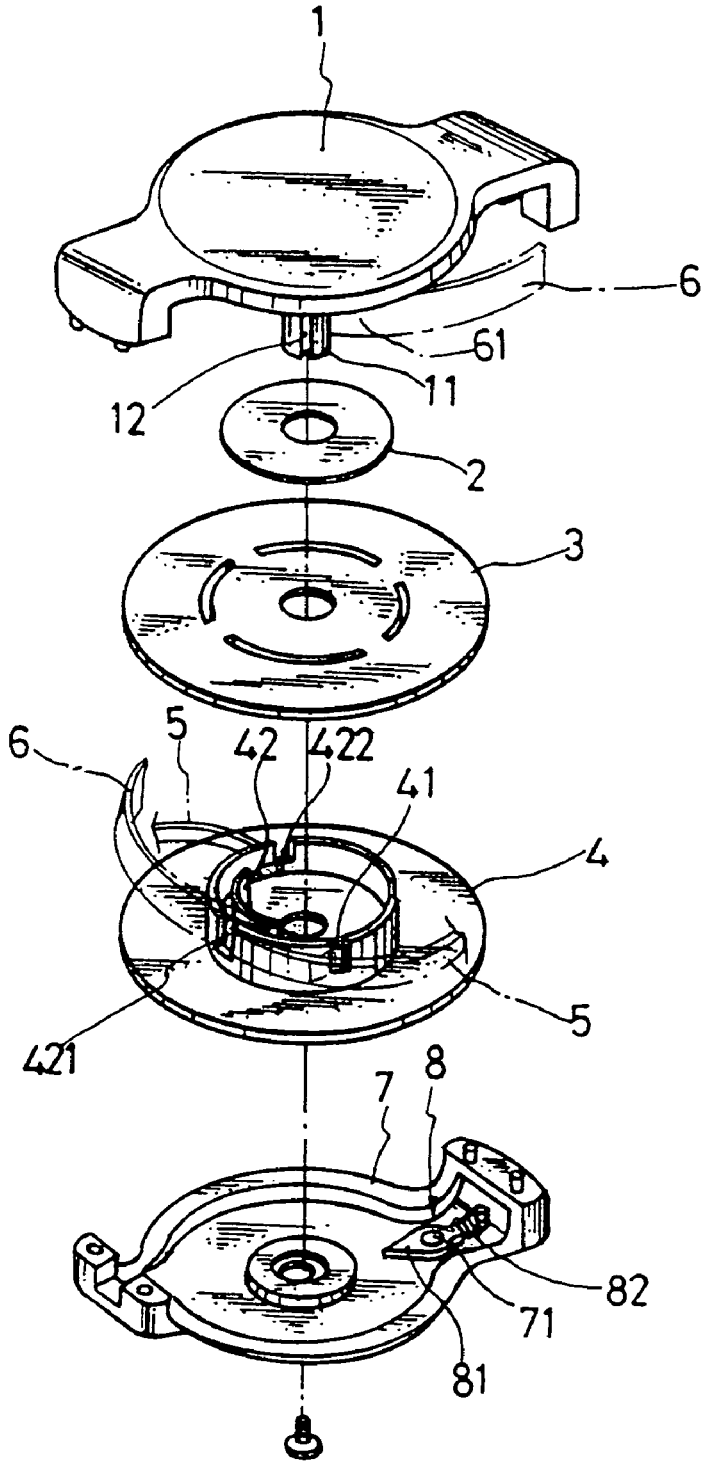
FIG. 2 is an exploded perspective view of the preferred embodiment of the present invention.
Figure 3:
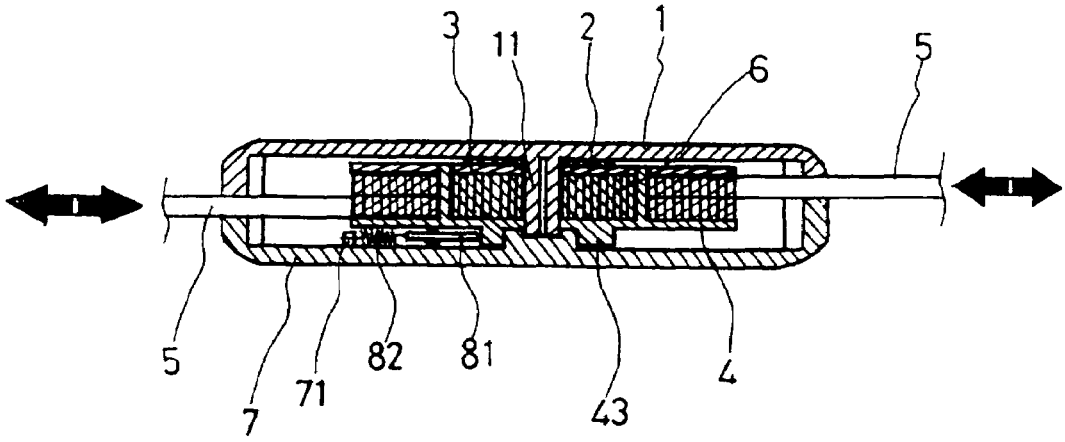
FIG. 3 is a sectional view of the positioning device of a dual direction cable reel of the present invention.

Referring to FIGS. 1, 2 and 3, there is shown a positioning device of a dual direction cable reel comprising a top cover 1, a pad 2, a reeling disc top cover 3, a reeling disc 4, a coiled cable 5, a spring 6, a bottom cover 7, and a positioning member 8. The center of the spring 6 is connected to the engaging slot 12 of the center shaft 11 of the top cover 1. The outer end 61 of the spring 6 is engaged with the engaging slot 41 of the reeling disc 4. When the reeling disc 4 rotates clockwise or anti-clockwise, the spring 6 within the reeling disc 4 will either become taut or loosen. The tautness of the spring 6 provides a retraction force to the cable reel.

A clipping plate 42 is provided to the edge wall of the reeling disc 4 and the coiled cable 5 is led via the corresponding slit 421. The coiled cable 5 is led to the outer edge of the reeling disc 4, and the middle section of the coiled cable 5 is guided along the clipping plate 42 and the opening 422 to wind onto the reeling disc 4. An upper and lower frame position divide the coiled cable 5.

In accordance with the present invention, as shown in FIG. 2, the positioning member 8 includes a peg 81 and a pulling spring 82, and the peg 81 is pivotally mounted to a positioning peg 71 at the outer side of the inner edge of the bottom cover 7. The pulling spring 82 is pulled to keep the peg 81 at a correct direction.

Figure 4:
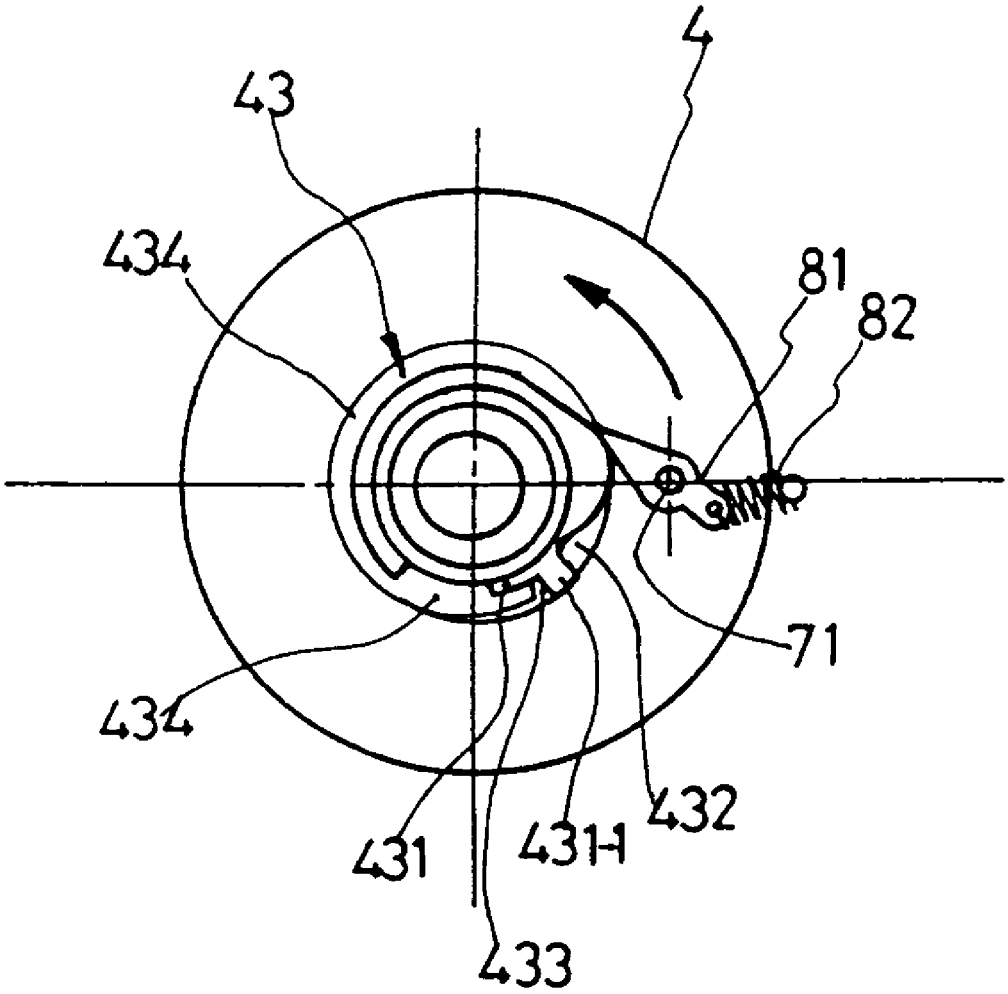
FIG. 4 is a schematic view of the reeling disc rail and the positioning structure of the present invention.

As shown in FIG. 4, the bottom section of the reeling disc 4 is provided with a plurality of functional rails 43 which include a pushing section 431, a second pushing section 431-1, a direction-changing section 432, an engaging slot 433 and a sloping leading face 434. As shown in FIG. 4, the peg 81 has a large angle inclined upward, following the direction of rotation and will not generate engaging action. The peg 81 has a coiled cable 5 being pulled out from a related position of the peg 81.

Figure 5:
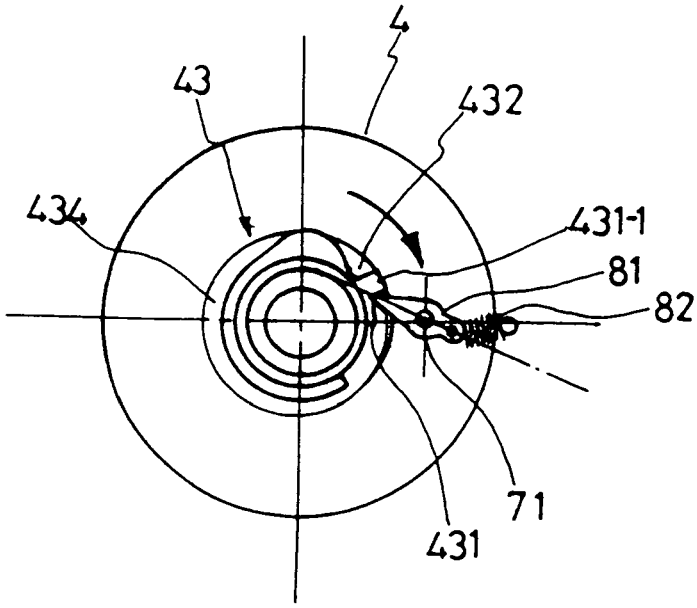
FIGS. 5 to 9 show schematic views of the reeling disc and the positioning structure in accordance with the present invention.

As shown in FIG. 5, when the cable reel is loosened, the spring 6 restores its power and the reeling disc 4 rotates in a counter clockwise. At this instance, the peg 81 is led to the engaging slot 433 and the cable reel has a positioning function. In particular, the engaging positioning is tangential to the bottom cover peg 71, the peg 81, and the peg 81 is fully engaged without swinging.

Figure 6:
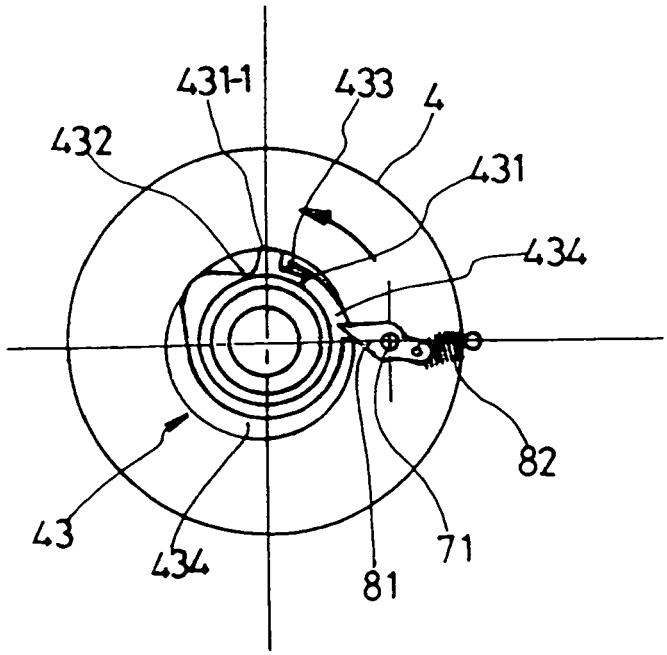
Figure 7:
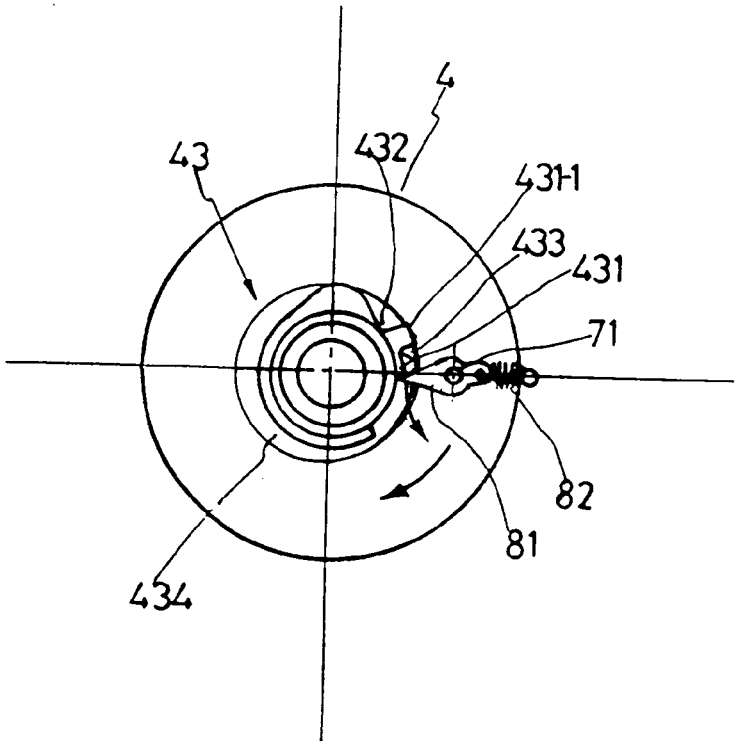
Figure 8:
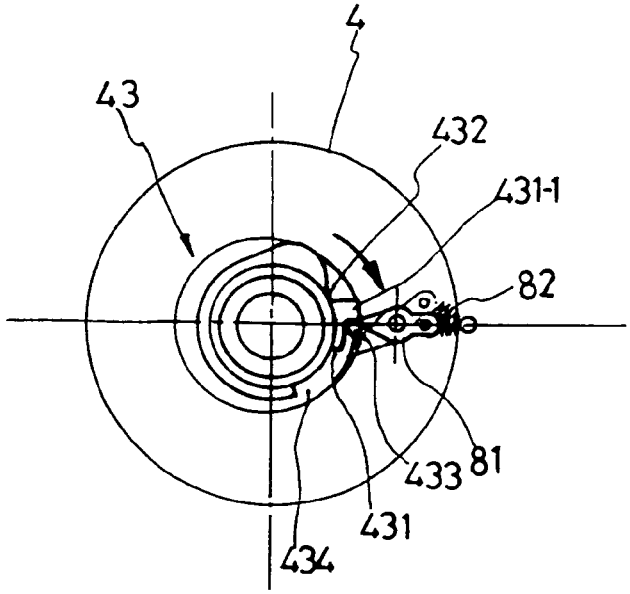

Referring to FIG. 6, when the peg 81 is loosened, the engaged cable reel is pulled and the reeling disc 4 rotates in a reverse direction. The corresponding peg 81 moves along the leading face 434 into the pushing section 431 so that the peg 81 is rapidly pushed. As shown in FIG. 7, the second pushing section 431-1 causes the peg 81 to form a large angle to enter the range of the direction-rotating section 432. As shown in FIG. 8, at this instance, the cable reel is at a loosening status, and therefore, the coiled wire 5 retracted back at one retraction of the spring.

Figure 9:
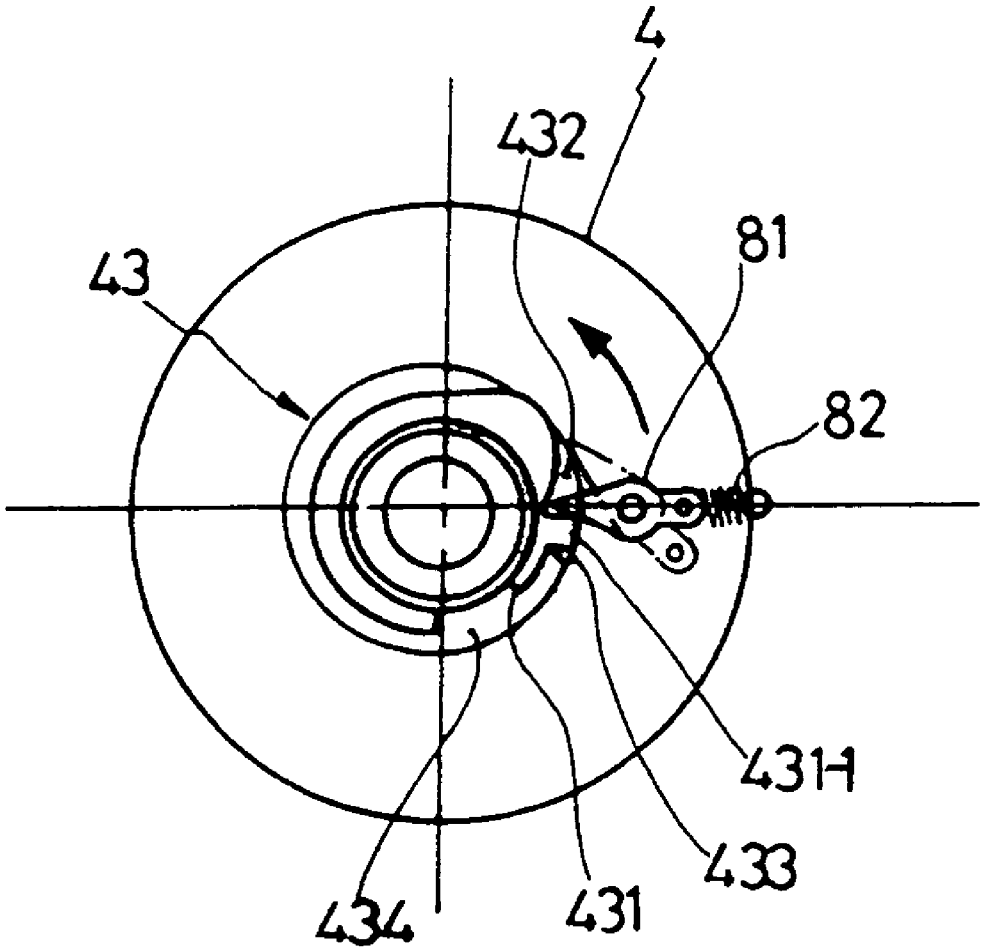
Figure 10:
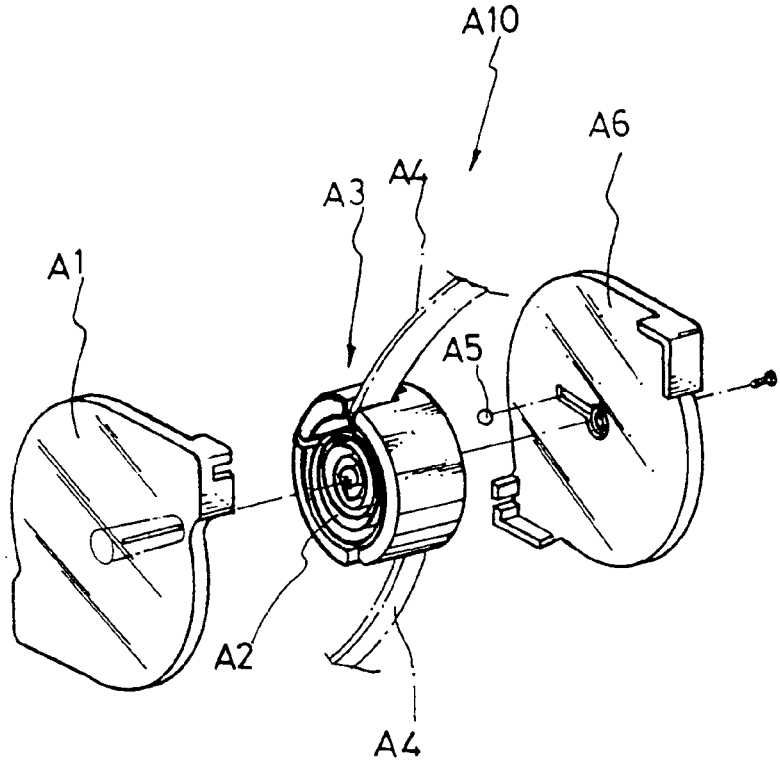
PRIOR ART FIG. 10
FIG. 10 is a conventional exploded view of the steel bead positioning cable reel.
Figure 11:
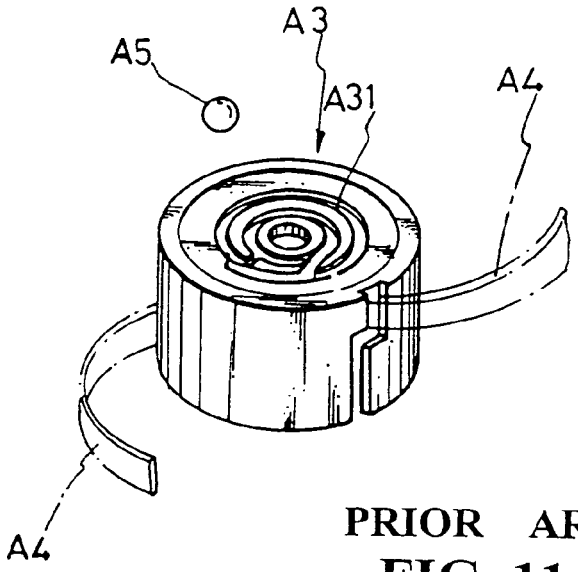
PRIOR ART FIG. 11
FIG. 11 is a schematic view showing the bottom section of the sliding seat of the conventional bead positioning cable reel.

As shown in FIG. 9, when the retraction is to be subsequently made, before the coiled cable 5 is retracted, the coiled cable 5 is pulled once again, and the coiled cable 5 rotates in a reverse direction about the reeling disc 4, and at this instance the peg 81 being limited by the direction-rotating section 432 to reverse the direction of the peg, the peg 81 is at a status shown in FIGS. 4 and 5, which shall be engaged by the engaging slot 433 if it rotates in a reverse direction.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A positioning device of a dual direction cable reel comprising:

a top cover having a center shaft, said center shaft having an engaging slot;

a reeling disc having an engaging slot, an opening and a slit, said reeling disc having a bottom section provided with a plurality of functional rails, said functional rails including a first pushing section, a second pushing section, a direction-changing section, an engaging slot and a sloping leading face; a peg having an angle inclined upward engaging the functional rails;

a spring having a center engaged with said engaging slot of said center shaft of said top cover, said spring having an outer end engaged with said engaging slot of said reeling disc;

a reeling disc top cover mounted on said reeling disc;

a pad mounted between said top cover and said reeling disc top cover;

a clipping plate provided to an edge wall of said reeling disc;

a coiled cable guided by said slit of said reeling disc to an outer edge of said reeling disc, an intermediate section of said coiled cable being guided along said clipping plate and said opening of said reeling disc to wind on said reeling disc;

a bottom cover in which is fitted said reeling disc; and a positioning member having the peg and a pulling spring, said peg being pivotally mounted to a positioning peg at an outer side of an inner edge of said bottom cover and connected at one end of said pulling spring, said pulling spring being pulled by the functional rails to keep said peg at a predetermined direction.

* * * * *